US008648240B2

(12) United States Patent
Hildebrand

(10) Patent No.: US 8,648,240 B2
(45) Date of Patent: Feb. 11, 2014

(54) VIRTUAL TUNING OF A STRING INSTRUMENT

(75) Inventor: Harold A. Hildebrand, Felton, CA (US)

(73) Assignee: Auburn Audio Technologies, Inc., Scotts Valley, CA (US)

( * ) Notice: Subject to any disclaimer, the term of this patent is extended or adjusted under 35 U.S.C. 154(b) by 211 days.

(21) Appl. No.: 13/347,532

(22) Filed: Jan. 10, 2012

(65) Prior Publication Data

US 2012/0174731 A1 Jul. 12, 2012

Related U.S. Application Data

(60) Provisional application No. 61/432,085, filed on Jan. 12, 2011, provisional application No. 61/441,246, filed on Feb. 9, 2011.

(51) Int. Cl.
*G10D 7/02* (2006.01)
*G10H 7/00* (2006.01)

(52) U.S. Cl.
USPC ..... 84/454; 84/600; 84/601; 84/602

(58) Field of Classification Search
None
See application file for complete search history.

(56) References Cited

U.S. PATENT DOCUMENTS

| | | | | |
|---|---|---|---|---|
| 5,367,120 | A | 11/1994 | Hoshiai | |
| 5,731,533 | A | 3/1998 | Hoshiai | |
| 5,824,929 | A * | 10/1998 | Freeland et al. | 84/454 |
| 5,859,378 | A * | 1/1999 | Freeland et al. | 84/454 |
| 5,973,252 | A * | 10/1999 | Hildebrand | 84/603 |
| 5,977,467 | A * | 11/1999 | Freeland et al. | 84/454 |
| 6,066,790 | A * | 5/2000 | Freeland et al. | 84/454 |
| 6,995,311 | B2 * | 2/2006 | Stevenson | 84/737 |
| 7,102,072 | B2 * | 9/2006 | Kitayama | 84/616 |
| 7,271,329 | B2 * | 9/2007 | Franzblau | 84/609 |
| 7,514,620 | B2 * | 4/2009 | Friedman et al. | 84/454 |
| 7,595,443 | B2 * | 9/2009 | Yagi | 84/600 |
| 7,807,908 | B1 * | 10/2010 | Adamson | 84/312 R |
| 2003/0029298 | A1 | 2/2003 | Feiten et al. | |
| 2004/0187673 | A1 | 9/2004 | Stevenson | |
| 2008/0257136 | A1 | 10/2008 | Meeks | |
| 2011/0088535 | A1 * | 4/2011 | Zarimis | 84/645 |
| 2012/0174731 | A1 * | 7/2012 | Hildebrand | 84/312 R |

OTHER PUBLICATIONS

PCT International Search Report and Written Opinion for PCT/US2012/020820, May 17, 2012, 10 pages.

Smith, J.O., "Efficient Yet Accurate Models for Strings and Air Columns using Sparse Lumping of Distributed Losses and Dispersion," Center for Computer Research in Music and Acoustics, Dec. 1990, 18 pages.

Smith, J.O., "J.O. Smith III Comments on Sullivan Karplus-Strong Article," Letters, The MIT Press, Computer Music Journal, vol. 15, No. 2 (Summer, 1991), pp. 10-11.

Sullivan, C., "Extending the Karplus-Strong Algorithm to Synthesize Electric Guitar Timbres with Distortion and Feedback," Computer Music Journal, Fall 1990, pp. 26-37, vol. 14, No. 3.

* cited by examiner

*Primary Examiner* — Robert W Horn
(74) *Attorney, Agent, or Firm* — Fenwick & West LLP

(57) ABSTRACT

In an un-tuned state, the strings of a string instrument are excited, and a standard adjustment factor is determined for each string. When a pitch is generated as a result of a string being strummed (e.g., during normal playing of the instrument), the pitch generated by the string is adjusted by the standard adjustment factor and an intonation adjustment factor that accounts for intonation errors. An adjusted pitch is output that is in-tune and has accurate intonation.

11 Claims, 5 Drawing Sheets

300

302 304 306 308

| String | Note | Frequency | Adjustement Factor |
|---|---|---|---|
| 1 (Highest) | E | 329.63 Hz | 1.00364 |
| 2 | B | 246.94 Hz | 0.97762 |
| 3 | G | 196.00 Hz | 1.1044 |
| 4 | D | 146.83 Hz | 1.0562 |
| 5 | A | 110.00 Hz | 0.94315 |
| 6 (Lowest) | E | 82.41 Hz | 0.91246 |

FIG. 3

VIRTUAL TUNING OF A STRING INSTRUMENT

CROSS-REFERENCE TO RELATED APPLICATION

This application claims the benefit of U.S. Provisional Application No. 61/432,085, filed Jan. 12, 2011, and U.S. Provisional Application No. 61/441,246, filed Feb. 9, 2011, each of which is incorporated by reference in its entirety.

This application is also related to U.S. Pat. No. 5,973,252, filed Oct. 14, 1998, which claims priority to U.S. Provisional Application 60/063,319, filed Oct. 27, 1997, each of which is incorporated by reference in its entirety.

BACKGROUND

The embodiments described herein generally relate to musical instruments and in particular to tuning string instruments.

When each string on a string instrument is tuned to a certain reference pitch, the instrument is considered to be in tune. A tuned instrument allows a person to create enjoyable music. However, over time the strings will drift away from producing their respective reference pitch. This is referred to as the instrument becoming out of tune. Some factors that contribute to the instrument becoming out of tune are the material and age of the strings, changes in temperature, the way the instrument is played, and the material and design of the instrument.

Manually tuning an instrument each time it becomes out of tune is time consuming and an unpleasant experience. Current systems exist that detect when an instrument is out of tune and automatically tune the instrument by using a mechanical apparatus to adjust the individual strings of the instrument. Some drawbacks of these systems are that they are expensive, bulky, add weight to the instrument, are limited to small pitch changes, and are not compatible with many different types of string instruments. Accordingly, there is a need for an improved system for tuning string instruments.

SUMMARY

Embodiments described herein provide methods and systems for tuning a string instrument using digital signal processing. The embodiments comprise, during a calibration mode, a standard adjustment factor is determined for each string of the instrument. During a normal mode, when a pitch is generated as a result of a string being strummed, the pitch is adjusted according to the corresponding standard adjustment factor and an intonation adjustment factor that accounts for intonation errors. An adjusted pitch is output that is in-tune and has accurate intonation.

The embodiments described also provide methods and systems for alternatively tuning a string instrument. During a calibration mode, a standard adjustment factor is determined for a string of an instrument based on a first pitch generated by shortening and strumming the string. During a normal mode, when a pitch is generated by the string, the pitch is adjusted based on the standard adjustment factor. Therefore, by calibrating using a shortened string, the string is alternatively tuned.

BRIEF DESCRIPTION OF THE DRAWINGS

FIG. 3 is a table illustrating standard tuning of a guitar according to one embodiment.

The figures depict various embodiments of the invention for purposes of illustration only. One skilled in the art will readily recognize from the following discussion that alternative embodiments of the structures and methods illustrated herein may be employed without departing from the principles of the invention described herein.

DETAILED DESCRIPTION

Overview

A tuning system is described herein that enables the tuning of an electric string instrument using digital signal processing. In one embodiment, when the system is in calibration mode, a standard adjustment factor is determined for each string of the instrument. The standard adjustment factor of a string is a pitch adjustment made in order for the string to be in tune according to a standard tuning.

When the system is in normal mode and a string is strum, the system measures the pitch generated by the strumming of the string and adjusts the pitch by a total adjustment factor (TAF) of the string. The TAF is calculated based on the standard adjustment factor and an intonation adjustment factor.

The intonation adjustment factor accounts for intonation errors, which may be caused, for example, by excessive finger pressure on the strings against the frets. If the measured pitch were only adjusted by the standard pitch adjustment factor, the adjusted pitch may not be at a desired pitch on a chromatic scale because of intonation errors. Therefore, the intonation adjustment factor ensures that the adjusted pitch will be at the desired pitch.

Accordingly, with the tuning system, an electric string instrument that is out of tune can still be played and will produce in-tune sounds with accurate intonation. Described below are specific embodiments of the tuning system.

System Architecture

Figure 1:
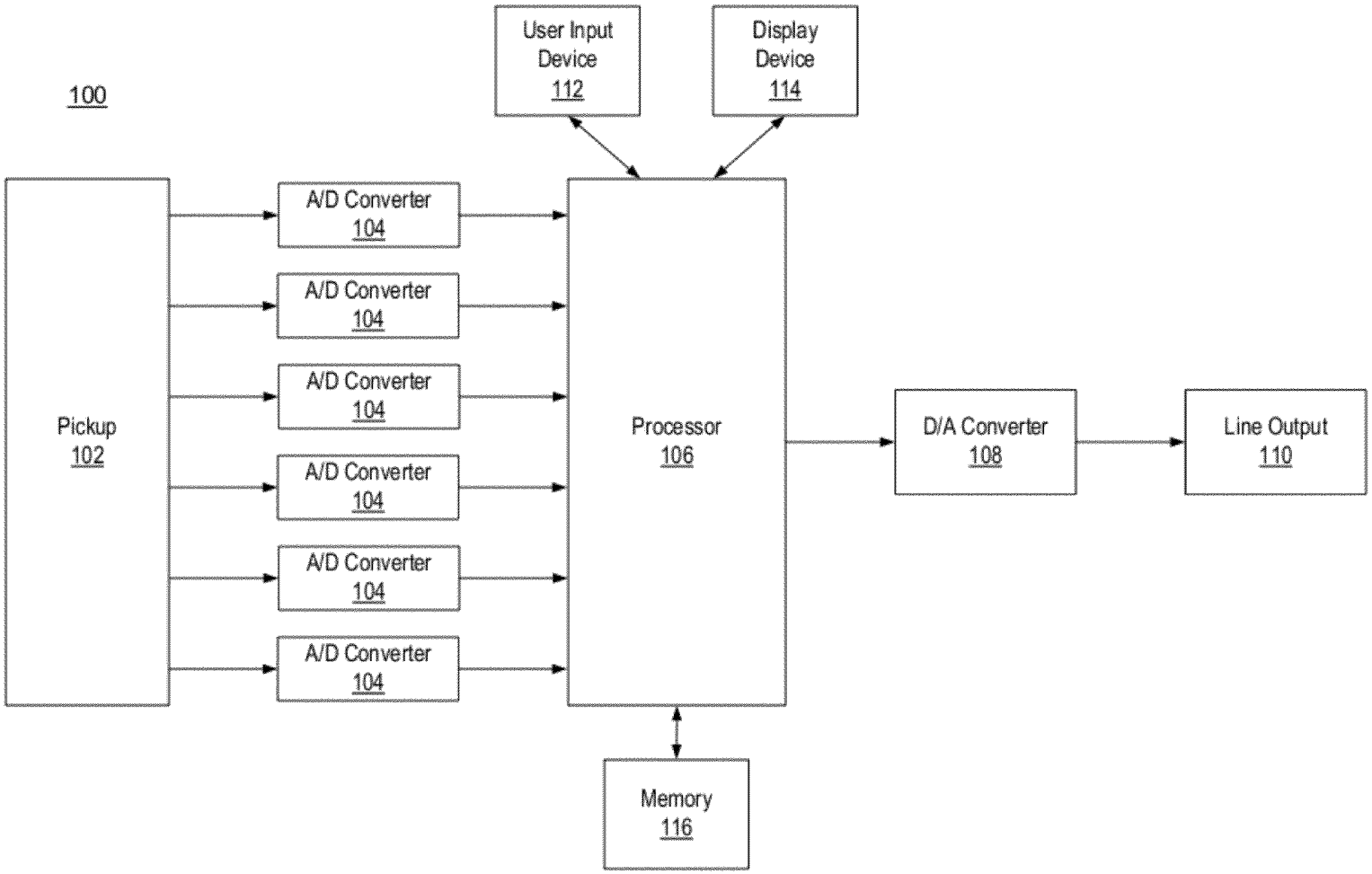
FIG. 1 is a block diagram of a tuning system according to one embodiment.

FIG. 1 is a block diagram of the tuning system 100 according to one embodiment. In one embodiment, the tuning system 100 is attached to an instrument. In another embodiment, the tuning system 100 is integrated and part of the instrument. The instrument may be any type of electric string instrument, such as an electric guitar, bass, violin, banjo, etc. The instrument may also be an acoustic string instrument with a pickup.

The tuning system 100 illustrated in FIG. 1 includes a pickup 102, analog to digital converters (A/D converters) 104, a processor 106, a digital to analog converter (D/A converter) 108, and a line output 110. The pickup 102 is a transducer that detects the vibration of each of the instrument's strings. In one embodiment, the pickup 102 is a hex pickup. In other embodiments, a different type of transducer may be used instead of the pickup 102.

The pickup 102 includes a wire pair for each string of the instrument. For example, if the instrument is a six string guitar, the pickup 102 will include six wire pairs. For each wire pair, the voltage across the wire pair varies based on the vibrations of its respective string. Thus, each wire pair generates an analog signal when its respective string is strum.

The pickup 102 is coupled to the A/D converters 104, which include interfacing circuits. The wire pairs of the pick 102 output their analog signals to the A/D converters 104. Each A/D converter 104 corresponds to a wire pair and receives analog signals output by the corresponding wire pair. Thus, in this embodiment, the number of A/D converters 104 is equal to the number of strings of the instrument. Although FIG. 1 shows six A/D converters 104, the tuning system 100 may have more or fewer A/D converters 104 depending on the number of strings of the instrument. In other embodiments, a single A/D converter 104 processes the analog signals output by the pickup 102.

Each A/D converter 104 samples an analog signal received from the corresponding wire pair to convert the analog signal into digital data. In one embodiment, each A/D converter 104 includes a low pass anti-alias filter, a clock source and an A/D conversion chip. The clock source defines the sampling rate of the analog signal. In one embodiment, the sampling rate is 44,100 samples per second. The output of each A/D converter 104 is coupled to the processor 106.

The processor 106 receives digital data output by the A/D converters 104. In one embodiment, the interface between the A/D converters 104 and the processor 106 is a serial I/O standard. In one embodiment, when digital data is received, the processor 106 issues an interrupt, causing the sequencer of the processor 106 to begin processing the data as described below. The processor 106 interfaces with a user input device 112, a display device 114, and a memory 116.

The user input device 112 is any device configured to allow a user of the system 100 to provide commands to the processor 106. The input device 112 may include a combination of input elements, such as buttons, switches, knobs, dials, a keyboard, a key pad, a cursor controller, and/or any representation of these created on a touch screen. In one embodiment, a user of the system 100 can control whether the processor 106 operates in a calibration mode or a normal mode using the user input device 112. In calibration mode, the processor 106 calibrates each string of the instrument. In normal mode, the processor 106 makes appropriate corrections to output sounds that are in-tune and have accurate intonation. Operations of the processor 106 in each mode are further described below.

Figure 4:
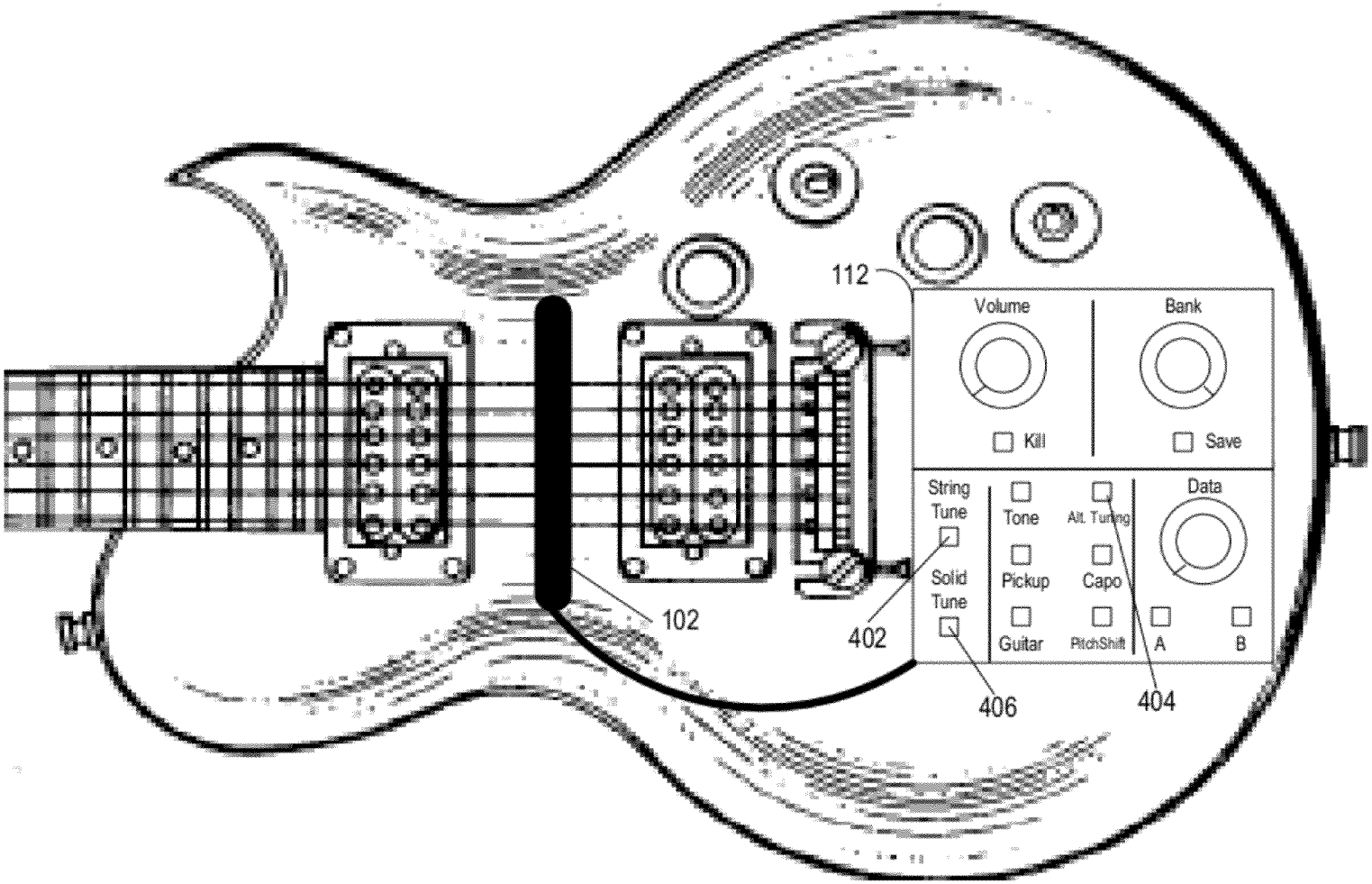
FIG. 4 is a diagram of a pickup and user input device of a tuning system according to one embodiment.

Using the input device 112, a user can also enable and disable string tuning, alternate tuning, and intonation tuning features described below. FIG. 4 illustrates the pickup 102 and the user input device 112 implemented on a six string guitar according to one embodiment. The user input device 112 includes a button 402 for the string tuning feature, a button 404 for the alternate tuning feature, and a button 406 for the intonation tuning feature. Each of these buttons can be used by a user to enable or disable the corresponding feature.

The display device 114 is any device equipped to display images and data as described herein. The display device 114 may be, for example, a light emitting diode display (LED), liquid crystal display (LCD), or any other similarly equipped display screen or monitor. In one embodiment, the display device 114 is equipped with a touch screen in which a touch-sensitive, transparent panel covers the screen of the display device 114. Alternatively, the display device 114 may provide audio feedback only.

The memory 116 stores instructions that may be executed by the processor 106. The instructions may comprise code for performing any and/or all of the techniques described herein. Memory 116 may be a dynamic random access memory (DRAM), a static random access memory (SRAM), Flash RAM (non-volatile storage), combinations of the above, or some other memory device known in the art.

The processor 106 is coupled to the D/A converter 108. Processed digital data output by the processor 106 is received by the D/A converter 108. In one embodiment, the processor 106 outputs to the D/A converter 108 a digital sum of the strings. Although FIG. 1 shows a single D/A converter 108, it should be understood that the tuning system 100 may have more D/A converters depending on the output implementation (e.g., stereo output). The D/A converter 108 is coupled to the line output 110. The D/A converter 108 converts the digital data received from the processor 106 into an analog signal and outputs the analog signal to the line output 110. The line output 110 may be, for example, coupled to an amplifier.

Calibration Mode

As described above, the processor 106 can operate in calibration mode or in normal mode. Calibration mode is initiated by a user providing a calibration command via the user input device 112. For the strings of the instrument to be calibrated, the strings have to be strum by a user of the instrument. The processor 106 can calibrate the strings one at a time or multiple strings simultaneously.

In one embodiment, the processor 106 will stay in calibration mode until each string of the device has been strum at least once and calibrated. If a string has not been strum during the calibration, a message is displayed via the display device 114 requesting that the user strum the string. In another embodiment, upon one or more strings being strummed and a calibration command being received via the input device 112, the processor 106 enters calibration mode, calibrates the one or more strings, and returns to normal mode. In another embodiment, the processor 106 stays in calibration mode for a set period of time before entering normal mode. In another embodiment, the processor 106 stays in calibration mode until the processor 106 receives a command via the input device 112 to enter normal mode.

When the processor 106 is in calibration mode and the pickup 102 detects the vibrations of a string, the processor 106 receives from an A/D converter 104 digital data representative of the pitch generated by the vibrations of the string. The processor 106 measures the pitch using the digital data. The processor 106 determines a standard adjustment factor, which is a factor by which the measured pitch deviates from a desired reference pitch according to the standard tuning of the instrument. Standard tuning is a tuning to which the strings of instrument are typically tuned.

To determine the standard adjustment factor, the processor 106 accesses a standard tuning table stored in the memory 116. The standard tuning table identifies the note each string should produce when unfretted under standard tuning and the corresponding frequency of each note. The processor 106 identifies in the table what the frequency of the note should be for the string (i.e., the frequency of the reference pitch). The processor 106 calculates the standard adjustment factor by taking the ratio between the frequency of the reference pitch, $F_{reference}$, and the frequency of the measured pitch, $F_{measured}$. Below is the equation for calculating the standard adjustment factor. The processor 106 updates the standard tuning table in the memory 116 to include the standard adjustment factor.

$$\text{Standard Adjustment Factor} = \frac{F_{reference}}{F_{measured}} \tag{1}$$

FIG. 3 illustrates an example of a standard tuning table 100 stored in the memory 116 for a six string guitar. Column 302 identifies the string, column 304 identifies what the note of the string should be under standard tuning, column 306 identifies the frequency of the note, and column 308 identifies the adjustment factor calculated for the string.

In one embodiment, the memory 116 stores alternate adjustment factors for each string. An alternate adjustment factor of a string is a deviation of a pitch of the string under standard tuning from a desired pitch under an alternate tuning. An alternate adjustment factor of a string is a ratio of the frequency of a pitch generated by the string under an alternate tuning, $F_{alternate}$, and the frequency of a pitch generated by the string under the standard tuning, $F_{standard}$. Below is an equation for calculating an alternate adjustment factor for a string.

$$\text{Alternate Adjustment Factor} = \frac{F_{alternate}}{F_{standard}} \tag{2}$$

In one embodiment, for a string, the memory 116 stores an alternate adjustment factor for one or more of the following alternate tunings of a six string guitar: double drop D, DADGAD, open G, open D, octaver, bass, bass GTR split, seven string, and twelve string. In one embodiment, for some alternate tunings of a string, the memory stores multiple adjustment factors. For example, for a twelve string tuning of a six string guitar, the alternate tuning is achieved by two pitches being generated for each string. Therefore, under this example, the memory 116 would store two adjustment factors for each string.

When a string is strum for calibration, the string can be shortened, by for example, pressing the string against a fret or fingerboard in order to alternatively tune the string. Shortening the string or the string being shortened signifies that the user has put pressure on the string to lessen the portion of the string that vibrates when strum (i.e., the user is fingering a note). By strumming a shortened string, the string becomes sharper in pitch and the resulting standard adjustment factor will flatten the corrected pitch that much more, thereby allowing to user to create custom alternate tunings.

As an example, assume that the low E string is pressed down at the first fret, strummed, and the processor 106 is placed in calibration mode while the string is still vibrating. Using the standard tuning table, the processor 106 would determine an adjustment factor to tune the pitch to low E. If during normal mode the string is strum unfretted, the string will be tuned to E-flat (one half step below E) because during calibration it was pressed at the first fret (one half step pitch increase).

Normal Mode

In one embodiment, when the processor 106 is not in calibration mode, it is in normal mode. Under normal mode, the processor 106 tunes the instrument as it is being played. The tunings that may be performed by the processor 106 include string tuning, alternate tuning, and intonation tuning. Each of these features is described below.

When a string is strum while in normal mode, the processor 106 measures the pitch generated by the string. Additionally, the processor 106 sets a total adjustment factor (TAF) equal to unity. The TAF is a factor by which the measured pitch is adjusted. However, prior to adjusting the pitch based on the TAF, the processor 106 calculates the factor.

To calculate the TAF, the processor 106 determines whether a string tuning feature is enabled. A user of the instrument enables the string tuning feature for the strings to be in-tune according to the standard tuning. If the string tuning is enabled, the processor 106 reads from the standard tuning table stored in memory 116 the standard adjustment factor of the string. The processor 106 sets the TAF to be equal to the current value of the TAF multiplied by the standard adjustment factor.

For example, assume that the system 100 is in normal mode, that the string tuning feature is enabled, and that the table 300 of FIG. 3 is the standard tuning table stored in memory 116. If the second string is strum, the processor 106 would read from the table 300 the standard adjustment factor of 0.97762 and would multiply the TAF by 0.97762.

The processor 106 also determines whether an alternate tuning feature is enabled. The alternate tuning feature is enabled by a user for the strings of the instrument to be in-tune according to an alternate tuning. If the alternate tuning feature is enabled, the processor 106 determines the specific alternate tuning to which the system 100 has been set by the user (e.g. DADGAD, open D). The processor 106 retrieves from memory 116 the alternate adjustment factor of the string that corresponds to the set alternate tuning. The processor 106 sets the TAF to be equal to the current value of the TAF multiplied by the alternate adjustment factor.

In one embodiment, when the alternate tuning feature is enabled, the standard tuning feature is also automatically enabled. The alternate adjustment factors, as described above, are calculated with the assumption that the pitches are at the standard tuning. Therefore, by automatically enabling the standard tuning feature it accounts for any deviation from the standard tuning so that a pitch can be alternatively tuned according to the alternate adjustment factor. However, in other embodiments, the two features may be independent where, for example, the alternate adjustment factors are calculated based on the measured pitch. In such embodiments, the alternate adjustment factors are not dependent on accounting for standard tuning.

Additionally, the processor 106 determines whether the intonation tuning feature is enabled. The intonation tuning feature accounts for intonation errors while still allowing pitch bending. Intonation is a measure of how accurately a pitch is produced. Intonation errors may be caused, for example, by how a user plucks a string, frets a string, or presses a string toward the finger board of the instrument. Any of these actions may cause a pitch to be too sharp or too flat. In one embodiment, the memory 116 stores multiple reference pitches and a frequency range associated with each of those pitches. In one embodiment, the reference pitches are pitches on the chromatic scale. In one embodiment, the frequency ranges do not overlap each other.

If the intonation tuning feature is enabled, the processor 106 determines an intonation adjustment factor to account for intonation errors. To determine the intonation adjustment factor the processor 106 identifies the current value of the TAF and determines what the measured pitch would be if adjusted by the current value of TAF (i.e., the adjusted pitch). For example, if the string tuning feature was enabled and the TAF was set based on a standard adjustment factor, the processor 106 would determine what measured pitch would be after being adjusted according to the standard adjustment factor.

The processor 106 determines whether the adjusted pitch is within a range of one of the stored ranges. If the adjusted pitch is within a range and at the reference pitch of the range, the processor 106 sets the intonation adjustment factor to one because the adjusted pitch has accurate intonation (i.e., no intonation errors need to be accounted for). If the adjusted pitch is within the range but not at the reference pitch, the processor 106 determines that the adjusted pitch has intonation errors and calculates the intonation adjustment factor to account for the errors and adjust the pitch to the reference pitch. Below is an equation to calculate the intonation adjustment factor, where $F_{reference}$ is the frequency of the reference pitch and $F_{adjusted}$ is the frequency of the adjusted pitch.

$$\text{Intonation Adjustment Factor} = \frac{F_{reference}}{F_{adjusted}} \tag{3}$$

If the adjusted pitch is not within any of the stored ranges, it is assumed that the user of the instrument is intentionally bending the note and that the intonation is not an error. Therefore, if the adjusted pitch is not within a stored range, the processor 106 sets the intonation adjustment factor to one since there is no need to account for intonation errors. Once the value of the intonation adjustment factor has been set, the processor 106 sets the TAF equal to the current value of the TAF multiplied by the standard adjustment factor.

Figure 5:
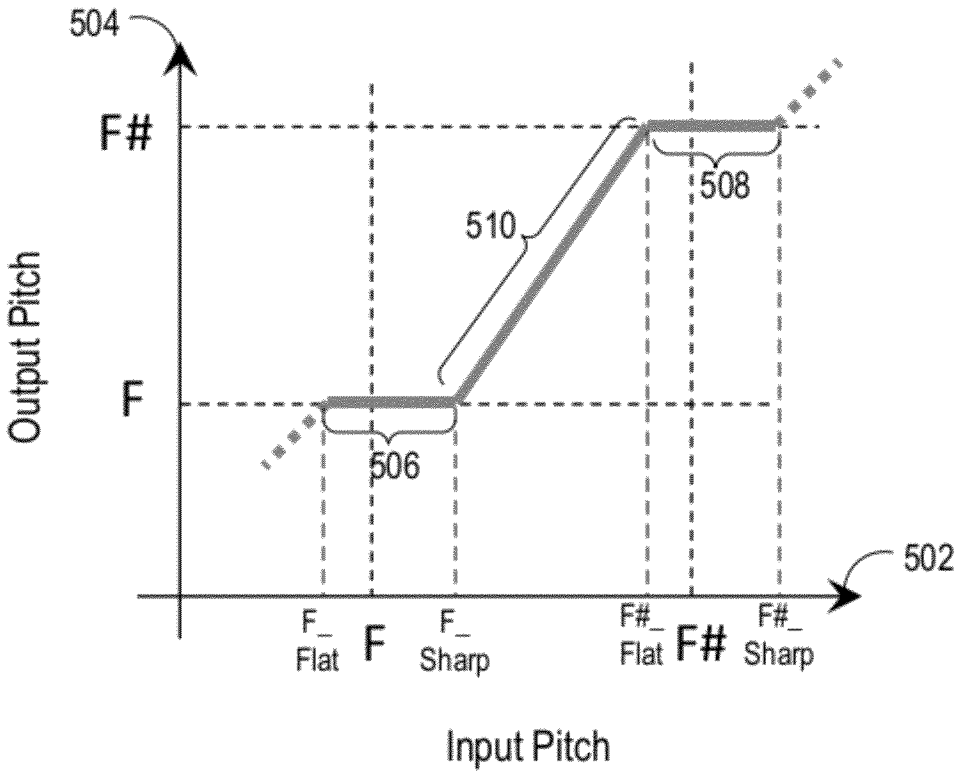
FIG. 5 is a graph of a transfer function for achieving accurate intonation according to one embodiment.

FIG. 5 illustrates a graph 500 of a transfer function implemented for performing the intonation tuning according to one embodiment. Specifically, the graph 500 of FIG. 5 illustrates the part of the transfer function in the vicinity of reference notes F to F# as would occur in every octave of the chromatic scale.

The horizontal axis 502 represents the input pitch of an accurately tuned or pitch adjusted string where the string was pressed to a fret when strummed. The vertical axis 504 represents the output pitch after intonation tuning is applied. Reference pitch F has a range 506 between F_Flat and F_Sharp. Reference pitch F# has a range 508 between F#_Flat and F#_Sharp.

If at any point the input pitch is precisely an F, the output pitch is also F because the input pitch has accurate intonation and as a result the processor 106 does not have to make a pitch adjustment. If the input pitch is not an F but is between the range 506 of F_Flat and F_Sharp, the processor 106 assumes it is a pitch error and calculates the intonation adjustment factor to compensate for the intonation and output an F.

When the input pitch is higher than F_Sharp, it is assumed the user of the instrument is bending the note. As a result, the processor 106 outputs a pitch that is sharper than F, as shown by the diagonal line 510. This relationship proceeds up to the F#_Flat, at which point the processor 106 again assumes the input pitch is an error. However, the processor 106 now outputs a pitch of F# because the input pitch is within the range 508 of F#_Flat and F#_Sharp.

Therefore, since the transfer function is continuous in pitch, the performance of the instrument feels natural to the user. In the extreme, when a user bends a note higher, the output pitch is bent accordingly in a natural way and sticks on the next higher half step. Accordingly, the intonation tuning feature makes it easier to hit a note accurately.

In one embodiment, the range of each reference pitch stored in memory 116 is preset. In another embodiment, the range of each reference pitch is adjustable by a user of the system 100 through the user input device 112. In one embodiment, the range of a reference pitch can be set to as little as zero and as high as the entire step of the pitch. In the one extreme where the range is set to zero, this setting basically neutralizes the intonation tuning feature. In the other extreme where the range is set to the entire step, a bend of a note becomes a specific affect of an instantaneous transition in pitch.

In one embodiment, the intonation tuning feature can only be enabled when the string tuning feature or alternate tuning feature is enabled. In another embodiment, the intonation tuning feature can be enabled even if the other features are disabled.

Based on the above, the TAF is calculated by taking into account the enabled features. For example, if the string, alternate, and intonation tuning features were enabled, the final calculated value of the TAF would be provided by the following equation:

$$TAF = \text{Standard Adj. Factor} * \text{Alternate Adj. Factor} * \text{Intonation Adj. Factor} \tag{4}$$

When the TAF is calculated taking into account the enabled features, the processor 106 adjusts the measured pitch by the TAF and outputs the adjusted pitch. Adjusting the measured pitch by the TAF includes the processor 106 using digital signal processing to resample and adjust the measured pitch using the TAF. The pitch to which the measured pitch is adjusted can be determined by multiplying the measured pitch by the TAF.

The string tuning, alternate tuning, and intonation tuning features have been described above as being applied to a single pitch. However, the processor 106 is capable of simultaneously applying string tuning, alternate tuning, and/or intonation tuning to pitches generated at the same time by different strings. In other words, the processor 106 is capable of tuning multiple strings at a time.

As described above, for certain alternate tunings, more than one pitch may need to be output for each string. In one embodiment, multiple pitches for a string are generated by duplicating a measured pitch generated by strumming a string and adjusting each measured pitch by its own TAF prior to outputting the pitch. The alternate adjustment factor used to calculate each TAF will be different and as a result the TAF's will be different.

For example, assume a six string guitar is set to an alternate tuning of a twelve string. Additionally, assume that for the twelve string alternate tuning, the memory 116 stores two alternate adjustment factors for each of the six strings. When a string is strum, the processor 106 measure the pitch. The processor 106 duplicates the measured pitch to create a first measured pitch and a second measured pitch of equal value. The processor 106 adjusts the first measured pitch according to a first TAF and adjusts the second measured pitch according to a second TAF. The processor 106 calculates the first TAF based on one of the alternate adjustment factors of the string and calculates the second TAF based on the other alternate adjustment factor of the string. As a result, two pitches are created for the string and output.

Digital Signal Processing

In one embodiment, to measure a pitch and adjust a pitch as described above, the processor 106 uses digital signal processing technology. The formulas used to measure and adjust a pitch are derived from auto-correlation functions of data. The auto-correlation of a sequence of data, $x_j$, having a period of repetition, L, is:

$$\Phi_L(n) = \sum_{j=0}^{L} x_j x_{j-n} \tag{5}$$

At time, I, given a sequence of sampled data, $\{x_j\}$, of a waveform of period L for j=0, . . . , i, the auto-correlation as a function of lag n can be expressed as:

$$\Phi_{i,L}(n) = \sum_{j=i-L-1}^{i} x_j x_{j-n} \tag{6}$$

To reduce the computations involved "E" and "H" functions are evaluated:

$$E_i(L) = \Phi_{i,2L}(0) = \sum_{j=0}^{2L} x_j^2 \tag{7}$$

The function $E_i(L)$ is the accumulated energy of the $$H_i(L) = \Phi_{i,L}(L) = \sum_{j=0}^{L} x_j x_{j-L} \tag{8}$$

waveform over two period, 2L. The lag argument, n, is not present. In other words, the auto-correlation value $E_i(L)$, is only computed at zero lag, and with the known period of repetition, L, ($H_i(L)$). At the time, i, given a sequence of data, $\{x_j\}$, for j=0, . . . , i, these equations can expressed as:

$$E_i(L)=E_{i-1}(L)+x_i^2-x_{i-2L}^2 \tag{9}$$

$$H_i(L)=H_{i-1}(L)+x_i x_{i-L}-x_{i-L}x_{i-2L} \tag{10}$$

In other words, for each prospective lag, L, four multiple-adds must be computed. It can be shown that $$E_i(L)\geq 2H_i(L) \tag{11}$$

and that $E_i(L)$ is nearly equal to $2H_i(L)$ only at values of L that are period of repetition of the data. Because the scaling of the data, $\{x_j\}$, is unknown, the term "nearly" must be interpreted relative to the energy of the signal. This results in a threshold test for detecting periodicity:

$$E_i(L)-2H_i(L)\leq_{eps} E_i(L) \tag{12}$$

where "eps" is a small number. When this condition is satisfied by varying the value of L, then L is a period of repetition of the data.

When the processor 106 receives digital data representative of a pitch from an A/D converter 104, the processor 106 detects and measures the frequency of the pitch by computing equations (9), (10), and (12) for values of L ranging from 2 to 110. For $\{x_j\}$ sampled at 44,100 Hz, this gives a frequency range of 2,756 Hz to 50.1 Hz of detectable frequencies.

To adjust a detected pitch, equations (9) and (10) are computed over a small range of L values around the detected pitch. As the input pitch shifts, the minimum value of equation (12) shifts, and the range of L values is shifted accordingly. The input waveform's period is then used to retune input waveform to the desired period (i.e., to the desired pitch frequency). Further, details for measuring and adjusting a pitch are described in U.S. Pat. No. 5,973,252, which is incorporated by reference herein.

Process

Figure 2:
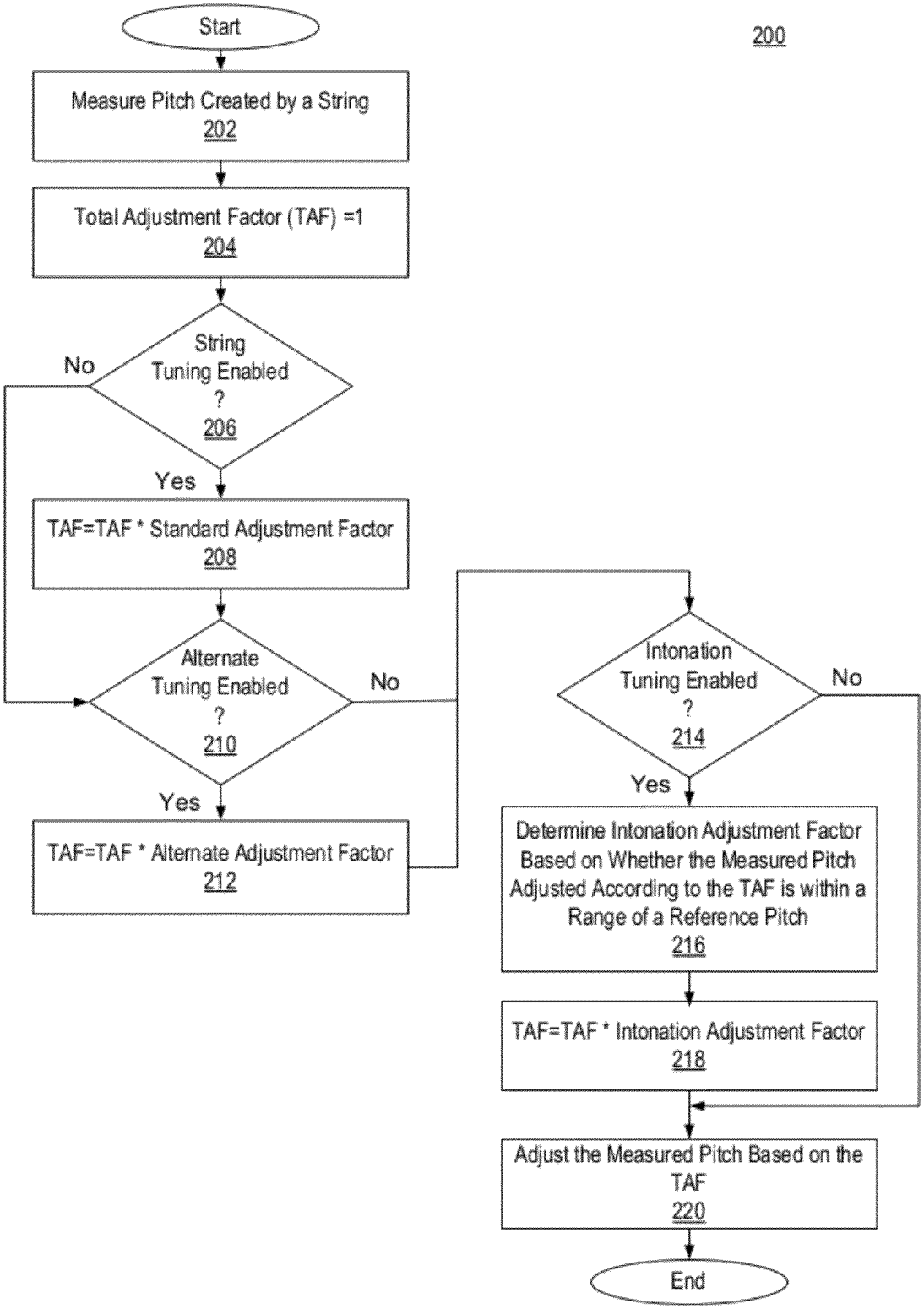
FIG. 2 is a flow diagram of a process performed by a tuning system for tuning a string instrument according to one embodiment.

FIG. 2 is a flow diagram 200 of a process performed by the tuning system 100 for tuning a string instrument according to one embodiment. Assume for purposes of this example that the system 100 has been integrated with the instrument and that a standard adjustment factor has been determined for each string of the instrument during calibration. Additionally, assume that the system 100 is in normal mode and that the at least one string of the instrument has been strum.

The system 100 measures 202 the pitch generated by the strumming of the string. The system 204 sets the value of the TAF equal to one. The system 100 determines 206 whether the string tuning feature is enabled. If the string tuning feature is disabled, the system 100 moves on to step 210. On the other hand, if the string tuning feature is enabled, the system 100 sets 208 the value of the TAF equal to the current value of the TAF multiplied by the standard adjustment factor of the string determined during calibration.

The system 100 determines 210 whether the alternate tuning feature is enabled. If alternate tuning feature is disabled, the system 100 moves on to step 214. However, if the feature is enabled, the system 100 sets 212 the value of the TAF equal to the current value of the TAF multiplied by the alternative adjustments factor of the string for the alternate tuning to which the system 100 is set.

The system 100 determines 214 whether the intonation tuning feature is enabled. If the intonation tuning feature is disabled, the system 100 moves on to step 220. However, if the feature is enabled, the system 100 determines 216 an intonation adjustment factor based on whether the measured pitch adjusted according to the current value of the TAF is within a range of a stored reference pitch.

If the adjusted pitch is at a reference pitch or not within a range of a reference pitch, the intonation adjustment factor is set equal to one. If the adjusted pitch is not at a reference pitch but is within a range of a reference pitch, the system 100 calculates the intonation adjustment factor based on the reference pitch and the adjusted pitch.

The system 100 sets 218 the value of the TAF equal to the current value of the TAF multiplied by the determined intonation adjustment factor. The system adjusts 220 the measured pitch based on the calculated TAF.

Summary

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus.

Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter.

What is claimed is:

1. A computer-implemented method for tuning a string instrument, the method comprising:

storing a reference standard pitch for a string of the string instrument;

measuring a pitch generated by a string of the string instrument;

determining an adjustment factor based on a comparison of the measured pitch and the stored standard pitch;

storing the adjustment factor for the string;

generating a continuous input signal based on measured vibrations of the string of the string instrument;

generating, by a processor, an output signal for the string based on the input signal, the generating comprising:

adjusting the input signal based on the stored adjustment factor for the string, identifying a closest reference note to a pitch of the adjusted input signal, if the pitch of the adjusted input signal is within an error threshold of the closest reference note, setting the adjusted input signal to have an output pitch equal to a pitch of the identified closest reference note, if the pitch of the adjusted input signal is outside the error threshold of the closest reference note, setting the adjusted input signal to have an output pitch equal to a function that is continuous and starts from the pitch of the identified closest reference note to a next reference note at a boundary of the error threshold, and outputting the adjusted input signal as the output signal for the string.

2. The method of claim 1, wherein the adjustment factor is determined responsive to a calibration command received from a user input.

3. The method of claim 1, further comprising:

receiving a user input to configure the error threshold for the string.

4. A method for tuning a string instrument having a plurality of strings, the method comprising performing the method of claim 1 for each of the plurality of strings.

5. A computer-implemented method for tuning a string instrument, the method comprising:

generating a continuous input signal based on measured vibrations of the string of the string instrument;

identifying a closest reference note to a pitch of the input signal;

if the pitch of the measured input signal is within an error threshold of the closest reference note, setting the input signal to have an output pitch equal to a pitch of the identified closest reference note;

if the pitch of the measured input signal is outside the error threshold of the closest reference note, setting the input signal to have an output pitch equal to a function that is continuous and starts from the pitch of the identified closest reference note to a next reference note at a boundary of the error threshold; and outputting the input signal as an output signal for the string.

6. The method of claim 5, further comprising:

receiving a user input to configure the error threshold for the string.

7. A method for tuning a string instrument having a plurality of strings, the method comprising performing the method of claim 5 for each of the plurality of strings.

8. A tuning system for a string instrument, the tuning system comprising:

a transducer configured to generate a continuous input signal based on measured vibrations of a string of the string instrument;

a processor configured to generate an output signal for the string based on the input signal by:

identifying a closest reference note to a pitch of the input signal, if the pitch of the measured input signal is within an error threshold of the closest reference note, setting the input signal to have an output pitch equal to a pitch of the identified closest reference note, if the pitch of the adjusted input signal is outside the error threshold of the closest reference note, setting the adjusted input signal to have an output pitch equal to a function that is continuous and starts from the pitch of the identified closest reference note to a next reference note at a boundary of the error threshold, and outputting the input signal as an output signal for the string.

9. The tuning system of claim 8, the tuning system further comprising:

a memory storing a reference standard pitch for the string of the string instrument;

wherein the processor is further configured to perform standard tuning of the string by:

measuring a pitch generated by a string of the string instrument, determining an adjustment factor based on a comparison of the measured pitch and the stored standard pitch, storing the adjustment factor for the string, and adjusting the input signal based on the stored adjustment factor for the string.

10. The tuning system of claim 8, wherein the processor is configured to perform standard tuning of the string responsive to a calibration command received from a user input.

11. The tuning system of claim 8, wherein the processor is further configured to receive a user input to configure the error threshold for the string.

* * * * *